US009216896B1

(12) United States Patent
Hegland

(10) Patent No.: US 9,216,896 B1
(45) Date of Patent: Dec. 22, 2015

(54) ANIMAL HALTER

(71) Applicant: Lisa Hegland, Camano Island, WA (US)

(72) Inventor: Lisa Hegland, Camano Island, WA (US)

(73) Assignee: Lisa Hegland, Camano Island, WA (US)

( * ) Notice: Subject to any disclaimer, the term of this patent is extended or adjusted under 35 U.S.C. 154(b) by 76 days.

(21) Appl. No.: 13/998,338

(22) Filed: Oct. 22, 2013

(51) Int. Cl.
*B68B 1/02* (2006.01)

(52) U.S. Cl.
CPC ..... *B68B 1/02* (2013.01)

(58) Field of Classification Search
CPC ..... B68B 1/02
USPC ..... 54/24, 85; D30/152; 119/792, 797, 831, 119/907
See application file for complete search history.

(56) References Cited

U.S. PATENT DOCUMENTS 4,135,348 A * 1/1979 Matthews ..... 54/24
4,524,569 A * 6/1985 Hanna ..... 54/24
4,852,336 A * 8/1989 Gammill ..... 54/24
5,038,717 A * 8/1991 Bent ..... A01K 15/02 119/815
7,340,874 B2 * 3/2008 Bechtold ..... 54/24
2006/0185331 A1 * 8/2006 Pretty ..... 54/24
2011/0252751 A1 * 10/2011 Nin ..... 54/24
2012/0110961 A1 * 5/2012 Verger ..... 54/24

* cited by examiner

*Primary Examiner* — David Parsley
*Assistant Examiner* — Danielle Clerkley

(57) ABSTRACT

A halter for positioning on the heads of animals with a nose band, a poll band, and cheek straps and a chin strap connected between them. The nose band formed from a nose strap and a jaw strap connected at opposed ends to a slot halter link. The poll band formed from a poll strap and a throat strap connected at opposed ends to a strap ring. One end of the jaw strap inserted through a halter link slot and attached to a slide buckle on the jaw strap. One end of the throat strap inserted through a strap ring and attached to a slide buckle on the throat strap. One end of the poll strap inserted through a strap ring and attached to a slide buckle on the poll strap. The poll strap may have two strap elements with a fastener to connect and disconnect the two strap elements.

8 Claims, 2 Drawing Sheets

ANIMAL HALTER

CROSS-REFERENCE TO RELATED APPLICATIONS

This patent application claims the benefit of U.S. Provisional Patent Application No. 61/158,443, filed on Mar. 9, 2009 and U.S. Provisional Patent Application No. 61/851,514, filed on Mar. 8, 2013. Patent Application No. 61/851,514. This is a continuation-in-part application of U.S. patent application Ser. No. 12/661,091, filed on Mar. 9, 2010. U.S. patent application Ser. No. 12/661,091.

BACKGROUND OF THE INVENTION

This invention relates to devices to be positioned on the head of livestock or animals for use in controlling, leading and tying of the animal. The new device or halter may have an adjustable length poll strap with fastener and an adjustable length jaw strap.

Devices such as halters have been used for centuries as a headpiece for animals to control, lead, hold and tie the animals. A variety of materials have been utilized through the years for halters including rope and straps of leather and synthetic material. Bulky or rough materials create an immediate response from an animal due in part to the thin layer of facial skin that may be susceptible to injury if equipment does not fit properly.

Typically halters have a nose band and a throat-poll band with cheek straps connecting the two bands. There often is a fixed chin or vertical strap connecting the two bands under the head of the animal. Buckles may be used on the halter and poll band element to allow placement of the halter on an animal and for adjustment in length of the poll band element depending on the size of the animal. There may also be a buckle with a catch on the jaw element of the nose band, often cumbersome, to allow length adjustment of the nose band.

SUMMARY OF THE INVENTION

The present invention is directed to devices to be positioned on the heads of animals as a halter. A nose band and a pol band may have two cheek straps and a chin strap connected between them. The nose band may be formed from a nose strap and a jaw strap that may be connected at opposed ends to a pair of opposed slot halter links. The pol band may be formed from a pol strap and a throat strap that may be connected at opposed ends to pair of opposed a strap rings. One end of the throat strap may be inserted through a strap ring and attached to a slide buckle on the throat strap. One end of the jaw strap may be inserted through a halter link slot and attached to a slide buckle on the jaw strap. One end of the pol strap may be inserted through a strap ring and attached to a slide buckle on the pol strap. The pol strap may have two strap elements with a fastener to connect and disconnect the two strap elements.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figures 1, 3:
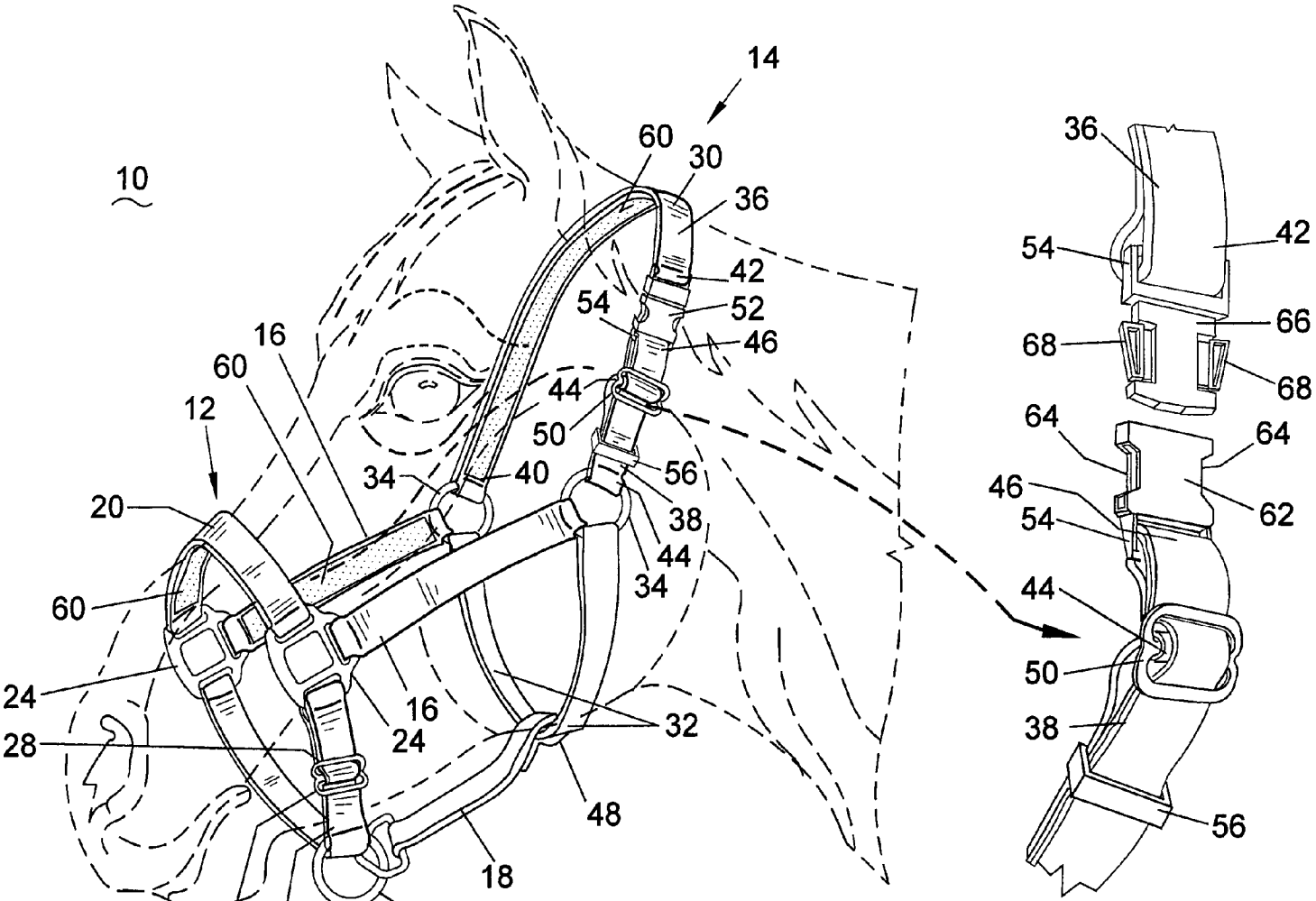
FIG. 1 illustrates a perspective view of a halter according to an embodiment of the invention.
FIG. 3 illustrates a plan view of a slide buckle according to an embodiment of the invention.
Figure 2:
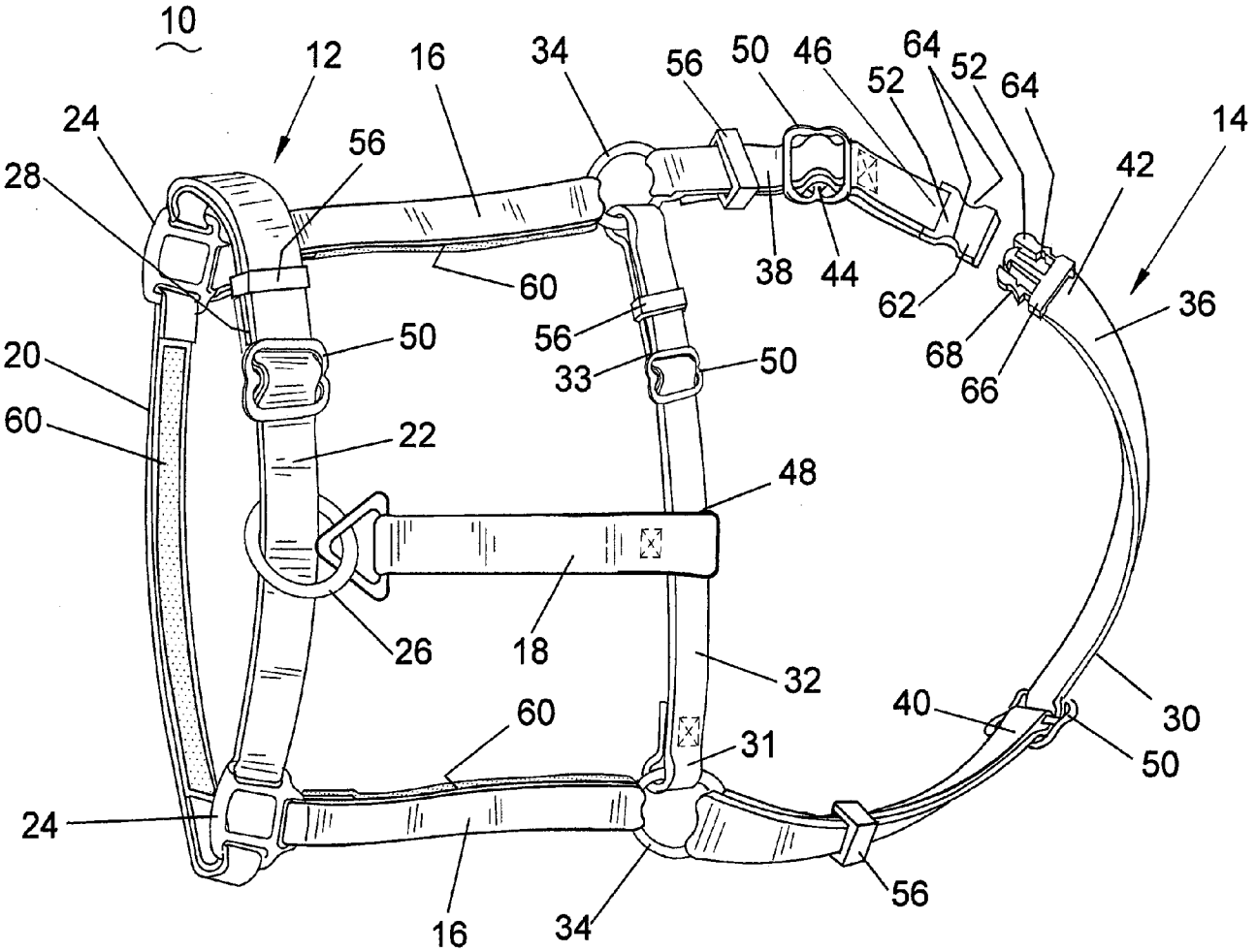
FIG. 2 illustrates a bottom view of a halter according to an embodiment of the invention.

Referring to FIGS. 1 through 3, a livestock or horse halter 10 may have a nose band 12 and a throat-pol band 14 with cheek straps 16 and a vertical or chin strap 18 connecting the two bands 12, 14. The nose band 12 may have an upper element nose strap 20 and a lower element or jaw strap 22 that are each connected at opposed ends by a pair of three slot halter links 24. A jaw ring 26 may be slidably positioned on the jaw strap 22. The pol band 14 may have an upper element pol strap 30 and a lower element or throat strap 32 that are each connected at opposed ends by a pair of strap rings 34.

The nose band 12 and pol band 14 may each have a friction slide buckle 50 to allow adjustment of the length of each band 12, 14 to fit the size of a particular animal. The jaw strap 22 may be inserted through the jaw rings 26 and may be fastened at one end 28 to a slide buckle 50 slidably positioned on the jaw strap 22. Movement of the slide buckle 50 on the jaw strap 22 may lengthen or shorten the strap length and thereby the nose band 12 length. The slide buckles 50 may be a sliding friction or pressure type device with a generally rectangular ring shape with a central cross member attached to two opposed sides and generally parallel to two opposed sides of the ring. The throat strap 32 may also be fastened at one end 31 to a strap ring 34 and at a second end 33 inserted through the opposed strap ring 34 and then fastened at the second end 33 to a slide buckle 50 slidably positioned on the throat strap 32.

The pol strap 30 may be structured with two strap elements 36, 38. The first strap element 36 may be attached at a first end 40 to a second one of the strap rings 34 and at a second end 42 to a buckle 52. The second strap element 38 may be attached at a second end 46 to the buckle 52 at D-ring 54 or slot in the buckle 52 and at a first end 44 may be inserted through a first one of the strap rings 34 and may be fastened to a slide buckle 50 that is slidably positioned on the second strap element 38. Movement of the slide buckle 50 on the pol strap 30 may lengthen or shorten the strap length and thereby the pol band 14 length.

While the slide buckle 50 is illustrated in FIGS. 1 and 3 as positioned on second strap element 38 of the pol strap 30, a slide buckle 50 may also be slidably positioned in a similar manner on first strap element 36 as illustrated in FIG. 2. This may be accomplished by routing the first end 40 of the first strap element 36 through the second strap ring 34 and looping the end 40 back to a fourth slide buckle 50 on strap element 36. The pol strap 30 may thereby have two slide buckles 50, one on each of the strap elements 36, 38, or may have a slide buckle 50 on one or the other of the strap elements 36, 38.

The buckle 52 may be a two piece, latch mechanism device with springs and catches incorporated to allow each piece to be slidably engaged for ease of connection and may have a spring biased disconnect device or button for ease of uncoupling the buckle pieces. The elements of the latch buckle 52 illustrated in FIG. 2 have a generally box shape receiving member 62 with side openings 64 for receipt and capture of protrusions 68 of the tongue member 66. Various quick connect-disconnect buckles such as with elastic protrusions may be available for use with the pol strap 30, see also FIG. 1.

The use of resilient protrusion or spring biased catches for tongue member 66, or a spring biased latch element in the receiver member 62 allows metal formed or structurally durable receiving members 62, 66 to resist inadvertent disconnect and a structure of a buckle to resist approximately 500 pounds of pull or impact. As illustrated in FIG. 3, the buckle 52 may have a box shaped receiving member 62 with side openings 64 for receipt and capture of tongue member 66 that has two spring biased slidable latch members 68. There may be a keeper 56 or loop of material slidably disposed on the pol, throat and jaw straps that have slide buckle 50 to retain adjacent strap elements to prevent a lose strap element from creating a hazard when a halter 10 is positioned on an animal. There may be instance, such as for very large horses, in which use of a center bar buckle with a pin may be desired to be used in place of the buckle 52. In such instances the structure for use of the center bar buckle with pin can be formed of a metal steel material and the first strap element 36 may only have one reinforced hole adjacent the second end 42 for receipt of the pin of the center bar buckle.

The various bands or straps may be constructed of man-made synthetic or natural materials. The pol strap 30, nose band 12 and cheek straps 16 may have a relatively soft padding material 60 attached for the comfort of an animal. The cheek straps 16 may each be attached at one end to a halter link 24 and at a second end to a strap ring 34. The chin strap 18 may be attached at one end to the jaw ring 26 and at a second end may be slidably disposed on the throat strap 32 at its approximate midpoint 48. The straps may be flat bands of material or circular material in a form similar to rope. The use of a latch mechanism device for buckle 52 with one or more slide buckles 50 creates a versatile, customized halter 10 for use with animals. The straps that are attached, i.e., that do not slide, to rings or buckles may be fastened by stitching such as line or box type stitching.

The halter 10 is adjustable by use of the slide buckle 50 on the nose band 12 and pol band 14. The preferred fit of the halter 10, no matter the material used for manufacture, may be two finger width space between halter 10 and the animal's face. The halter 10 does not require padding 60, but it may be useful when a horse is being transported, for example, in a trailer. Without the padding 60, the animal may feel what a user or handler wants through pressure points on the face and head, but the adjusted harness may not irritate or harm the animal. Padding 60 also may be attached on a portion of a strap in a location where a horse may normally experience discomfort with a halter 10, for example, in a portion of the upper portion of the first pol strap element 36 where there is no slide buckle 50 positioning.

While the invention has been particularly shown and described with respect to the illustrated embodiments thereof, it will be understood by those skilled in the art that the foregoing and other changes in form and details may be made therein without departing from the spirit and scope of the invention.

I claim:

1. An animal halter comprising:

a nose band and a pol band with two cheek straps and a vertical strap connected between said nose band and said pol band;

a nose strap and a jaw strap form said nose band, and a pol strap and a throat strap form said pol band;

said nose strap having a first looped end and a second looped end, said first looped end directly connected to a first halter link and said second looped end directly connected to a second halter link;

a first end of said jaw strap routed through a slot in said first halter link and directly attached to a first slide buckle that is slidably disposed on said jaw strap and a second end of said jaw strap routed through a slot in said second halter link, said first slide buckle is configured to provide infinite adjustment of the length of said jaw strap;

said pol strap including a first strap element and a second strap element, said first strap element having a first end routed through a first strap ring and directly fastened to a second slide buckle and a second end routed through a slot in a latch buckle and attached along an intermediate section of said first strap element, said second strap element having a first end routed through a second strap ring and directly fastened to a third slide buckle and a second end directly attached to said latch buckle;

said latch buckle comprising a tongue member having two spring-biased slidable latch members and a box-shaped receiving member having two side openings for receipt and capture of said latch members, wherein said latch buckle is configured to resist at least 500 pounds of pull or impact;

said second slide buckle and said third slide buckle are slidably disposed on said first strap element and said second strap element, respectively, and configured to provide infinite adjustment of the length of said first strap element and said second strap element;

said throat strap having a first end routed through said first strap ring and directly fastened to a fourth slide buckle and a second end routed through said second strap ring and attached along an intermediate section of said throat strap, said fourth slide buckle is configured to provide infinite adjustment of the length of said throat strap;

and wherein said first, second, third, and fourth slide buckles are a generally rectangular ring shape with a central cross member.

2. The animal halter as in claim 1 wherein a jaw ring is slidably disposed on said jaw strap, and said vertical strap is attached at a first end to said jaw ring and slidably disposed at a second end on said throat strap at an approximate midpoint.

3. The animal halter as in claim 1 wherein each of said first halter link and said second halter link has three slots therein and each of said cheek straps is attached at a first end to one of said first and second halter links and at a second end to one of said first and second strap rings.

4. The animal halter as in claim 1 wherein a keeper is slidably disposed on said jaw strap between said first slide buckle and said first halter link.

5. The animal halter as in claim 1 wherein a keeper is slidably disposed on said pol strap between said second slide buckle and said first strap ring.

6. The animal halter as in claim 1 wherein a keeper is slidably disposed on said pol strap between said third slide buckle and said second strap ring.

7. The animal halter as in claim 1 wherein a keeper is slidably disposed on said throat strap between said fourth slide buckle and said first strap ring.

8. The animal halter as in claim 1 wherein said pol strap, said nose band and said cheek straps have a generally soft padding material attached.

* * * * *